US006929524B2

(12) United States Patent
Ando

(10) Patent No.: US 6,929,524 B2
(45) Date of Patent: Aug. 16, 2005

(54) VACUUM ENVELOPE WITH SPACER AND IMAGE DISPLAY APPARATUS

(75) Inventor: Tomokazu Ando, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 66 days.

(21) Appl. No.: 10/309,169

(22) Filed: Dec. 4, 2002

(65) Prior Publication Data

US 2003/0080673 A1 May 1, 2003

Related U.S. Application Data

(62) Division of application No. 09/517,742, filed on Mar. 3, 2000, now Pat. No. 6,541,900.

(30) Foreign Application Priority Data

Mar. 4, 1999 (JP) ..... 11-057043

(51) Int. Cl.[7] ..... H01J 9/00; H01J 9/40
(52) U.S. Cl. ..... 445/24; 445/25
(58) Field of Search ..... 445/24, 25

(56) References Cited

U.S. PATENT DOCUMENTS

| | | | | |
|---|---|---|---|---|
| 5,448,131 A | | 9/1995 | Taylor et al. | 313/303 |
| 5,543,368 A | | 8/1996 | Kumar et al. | 313/495 |
| 5,708,325 A | | 1/1998 | Anderson et al. | 313/495 |
| 5,729,086 A | | 3/1998 | Jeong et al. | 313/495 |
| 5,821,689 A | | 10/1998 | Ando et al. | 313/495 |
| 5,990,614 A | | 11/1999 | Spindt | 313/495 |
| 6,153,973 A | | 11/2000 | Shibata et al. | 313/495 |
| 6,254,449 B1 | * | 7/2001 | Nakanishi et al. | 445/25 |

FOREIGN PATENT DOCUMENTS

| | | |
|---|---|---|
| EP | 0 725 418 | 8/1996 |
| EP | 0 851 458 | 7/1998 |
| EP | 0 867 911 | 9/1998 |
| JP | 7-235255 | 9/1995 |
| JP | 7-302560 | 11/1995 |
| JP | 8-241667 | 9/1996 |
| JP | 10-188861 | 7/1998 |
| JP | 2000-09859 | 3/2000 |

* cited by examiner

*Primary Examiner*—Mariceli Santiago
(74) *Attorney, Agent, or Firm*—Fitzpatrick, Cella, Harper & Scinto

(57) ABSTRACT

There is provided a vacuum envelope having at least a first substrate, a second substrate opposed to the first substrate with a predetermined distance thereto, and plural spacers positioned between the first and second substrates. A ratio η is defined by S/A, in which A is the internal cross-sectional area of the vacuum envelope in a cross-section parallel to a plane of one substrate opposed to the other substrate and S is the total cross sectional area of the plural spacers on such cross section, and satisfies a relation $0.78\% \leqq \eta \leqq 7.8\%$.

2 Claims, 4 Drawing Sheets

FRONT VIEW OF VACUUM CHAMBER
EMBODIMENT 1

SECTIONAL VIEW ALONG LINE2-2
EMBODIMENT 1

SECTIONAL VIEW ALONG LINE 4-4 VACUUM CHAMBER EMBODIMENT 1

SECTIONAL VIEW ALONG LINE 3-3 VACUUM CHAMBER EMBODIMENT 1

SCHEMATIC VIEW OF COLUMN SPACER
EMBODIMENT 1

SECTIONAL VIEW ALONG
LINE 4-4 VACUUM CHAMBER
EMBODIMENT 2

VACUUM ENVELOPE WITH SPACER AND IMAGE DISPLAY APPARATUS

This application is a divisional of application Ser. No. 09/517,742, filed on Mar. 3, 2000, now U.S. Pat. No. 6,541,900, issued on Apr. 1, 2003.

BACKGROUND OF THE INVENTION

1. Field of the Invention

The present invention relates to a flat panel image display apparatus adapted for use as a character or image display apparatus such as a display or a message board of a television receiver, a computer or the like.

2. Related Background Art

There is being commercialized a flat panel image display apparatus utilizing cold cathode electron-emitting devices such as a field emission type or a surface conduction type. The detailed configuration of such flat panel image display apparatus is disclosed in the Japanese Patent Application Laid-Open No. 07-235255.

As the above-described electron-emitting device requires high vacuum at least equal to $10^{-6}$ Torr for operation, there is required a vacuum envelope for constituting the image display apparatus employing such cold cathode electron-emitting device. Since the vacuum envelope is subjected to an external force caused by the pressure difference between the external atmospheric pressure and the pressure inside the vacuum envelope, there is required a support structure for maintaining the distance inside the vacuum envelope. In the absence of such support structure, the external force is supported by increasing the thickness of the constituents, but such configuration results in a drawback of an increased weight.

In consideration of the foregoing, there is proposed an image forming apparatus employing a vacuum envelope utilizing a spacer (Japanese Patent Application Laid-Open No. 07-302560). FIG. 8 illustrates a vacuum envelope of an image display apparatus utilizing the cold cathode electron-emitting device, wherein shown is a rear plate 1; a face plate 2 having a phosphor (not shown) and opposed to the rear plate 1; an outer frame 3 for connecting the periphery of the rear plate 1 and the face plate 2; flat plate-shaped spacers 4; and plural electron-emitting devices 5 mounted on the rear plate 1.

A support structure utilizing plural spacers is enabled to withstand the atmospheric pressure applied to the vacuum envelope. As a result, the rear plate 1 and the face plate 2 constituting the vacuum envelope can be made thinner to realize a vacuum envelope of a lighter weight and a larger area, whereby an image display apparatus of flat panel type can be realized.

SUMMARY OF THE INVENTION

Conventionally, the image quality may be deteriorated by the deformation of the vacuum envelope. The object of the present invention is to realize a more desirable configuration of the support structure for the vacuum envelope.

The above-mentioned object can be attained, according to the present invention, by a vacuum envelope constituted at least by a first substrate, a second substrate opposed to the first substrate with a predetermined distance thereto and plural spacers positioned between the first and second substrates, wherein a ratio $\eta$ of the vacuum envelop is defined by S/A in which A is the internal cross sectional area of the vacuum envelope in a cross section parallel to the principal plane of the first or second substrate and S is the total cross sectional area of the plural spacers on such cross section and satisfies a relation $0.018\% \leqq \eta \leqq 7.8\%$.

According to the present invention there is also provided an image display apparatus utilizing the vacuum envelope.

DETAILED DESCRIPTION OF THE PREFERRED EMBODIMENTS

According to the present invention, there is provided a vacuum envelope constituted at least by a first substrate, a second substrate opposed to the first substrate with a predetermined distance thereto and plural spacers positioned between the first and second substrates, wherein a ratio $\eta$ of the vacuum envelope is defined by S/A in which A is the internal cross sectional area of the vacuum envelope in a cross section parallel to the principal plane of the first or second substrate and S is the total cross sectional area of the plural spacers on such cross section and satisfies a relation $0.018\% \leqq \eta \leqq 7.8\%$.

There may also be adopted a configuration in which the first substrate is provided with the plural electron-emitting devices while the second substrate is provided with the phosphor for receiving the electrons emitted by the electron-emitting devices.

There may also be adopted a configuration in which the spacers are of two or more kinds.

Further, there may also be adopted a configuration in which the spacers are pillar-shaped, circular in the above-mentioned cross section, rectangular in the above-mentioned cross section, or polygonal in the above-mentioned cross section.

Further, there may also be adopted a configuration in which the spacers are elongated ones having the longitudinal direction non-parallel to the normal line to the above-mentioned cross section.

Further, there may also be adopted a configuration in which the spacers are vacuum envelopes that are rectangular in the above-mentioned cross section.

Also the electron-emitting devices mentioned above can be those of surface conduction type or those of field emission type.

The present invention also includes an image forming apparatus, particularly an image display apparatus and more particularly a flat panel image display apparatus, utilizing the above-described vacuum envelope.

The present invention realizes a more preferable vacuum envelope and a more preferable image forming apparatus.

Figure 1:
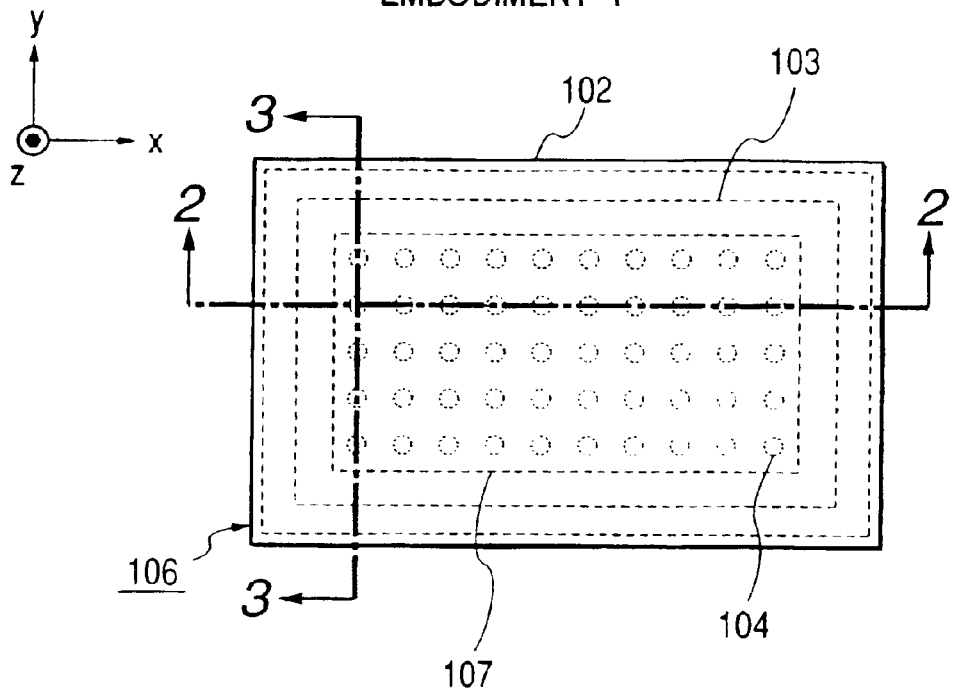
FIG. 1 is a schematic view showing an embodiment 1.
Figure 2:
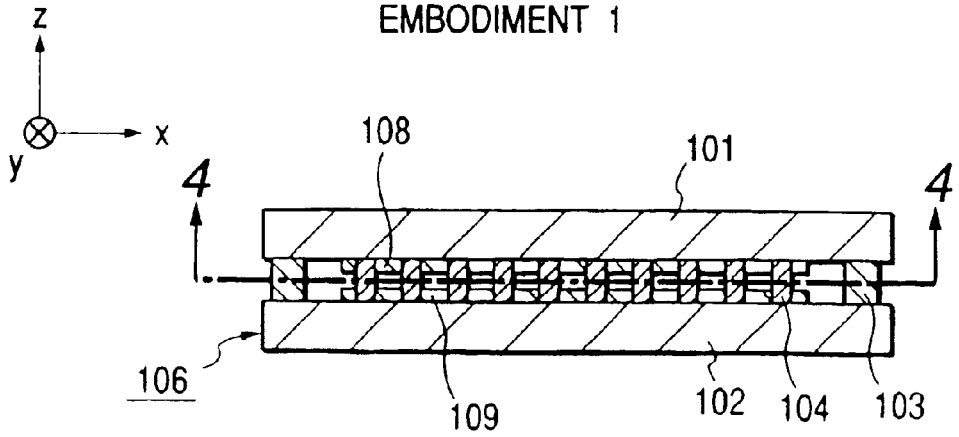
FIG. 2 is a schematic cross-sectional view showing the embodiment 1.
Figure 4:
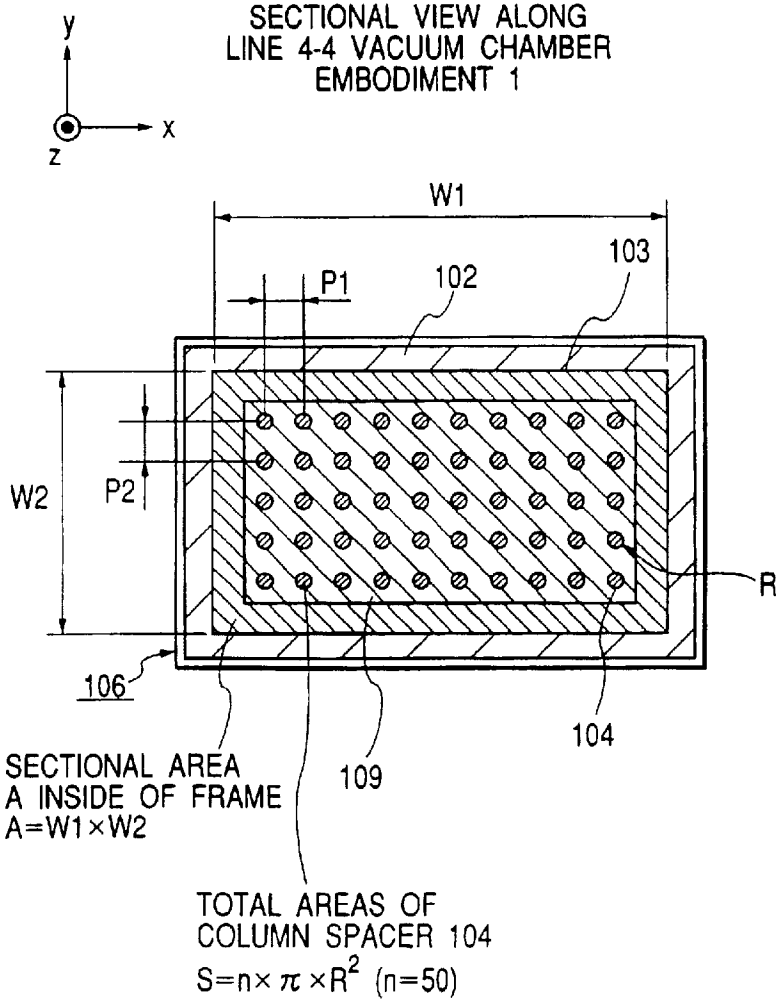
FIG. 4 is a schematic cross-sectional view showing the embodiment 1.
Figure 3:
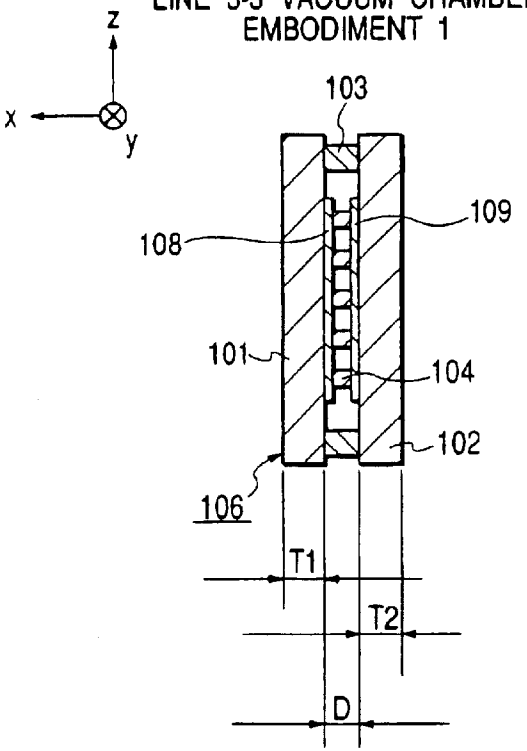
FIG. 3 is a schematic cross-sectional view showing the embodiment 1.

FIGS. 1 to 4 illustrate an embodiment of the vacuum envelope of the present invention, wherein FIG. 1 is a schematic view of the vacuum envelope; FIG. 2 is a cross-sectional view along a line 2—2 in FIG. 1; FIG. 3 is a cross-sectional view along a line 3—3 in FIG. 1; and FIG. 4 is a cross-sectional view along a line 4—4 in FIG. 2.

Referring to these drawings, there are shown a front substrate 101 (thickness T1); a rear substrate 102 (thickness T2) provided in a position opposed to the front substrate 101; a frame member 103 (internal dimensions of W1 in the x-direction and W2 in the y-direction) positioned to maintain a constant distance D between the two substrates and hermetically adhered thereto with frit glass; and cylindrical spacers 104 provided between the two substrates of the vacuum envelope and positioned on grid points of a pitch P1 in the x-direction and a pitch P2 in the y-direction. A vacuum envelope 106 is constituted by the front substrate 101, the rear substrate 102 and the frame member 103.

There are also shown surface conduction electron-emitting devices mounted on the rear substrate 102; a phosphor 108 mounted on the front substrate and emitting light by irradiation with the electrons generated by the electron-emitting device 109; and an image display area 107 for displaying an image by the light emission of the phosphor 108.

The spacers are constituent members for maintaining the distance D of the two substrates within an appropriate range and supporting, inside the vacuum envelope, the external force applied thereto by the atmospheric pressure.

Figure 5:
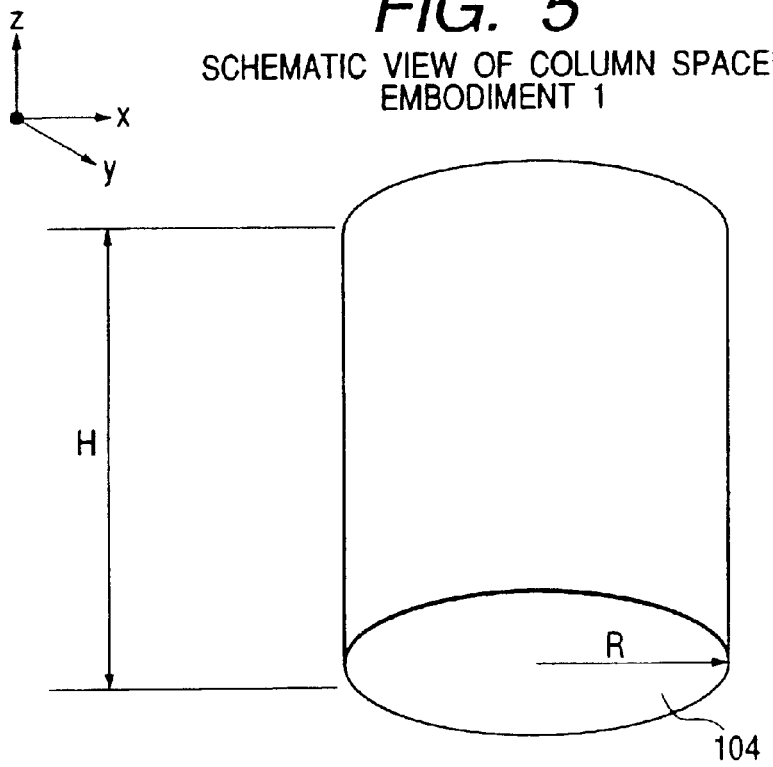
FIG. 5 is a perspective view showing the embodiment 1.

FIG. 5 illustrates, as an example of the pillar-shaped spacers, a cylindrical spacer of a circular cross section (radius R) and a height H. The pillar-shaped spacer means a spacer satisfying a relation $C<H$ wherein C is the representative length in a cross section along a plane perpendicular to the direction of the distance maintained by the spacer, or a cross section representing the cross-sectional shape in a 4—4 plane shown in FIG. 2. The representative length C is the diameter (2R) in case of a cylindrical spacer with a circular cross section, or the length of the longer axis in case of a pillar-shaped spacer with an oval cross section, or the longest diagonal in case of a pillar-shaped spacer with a polygonal cross section.

In the following there will be explained the support structure of the vacuum envelope employing such elongated spacer.

Figure 6:
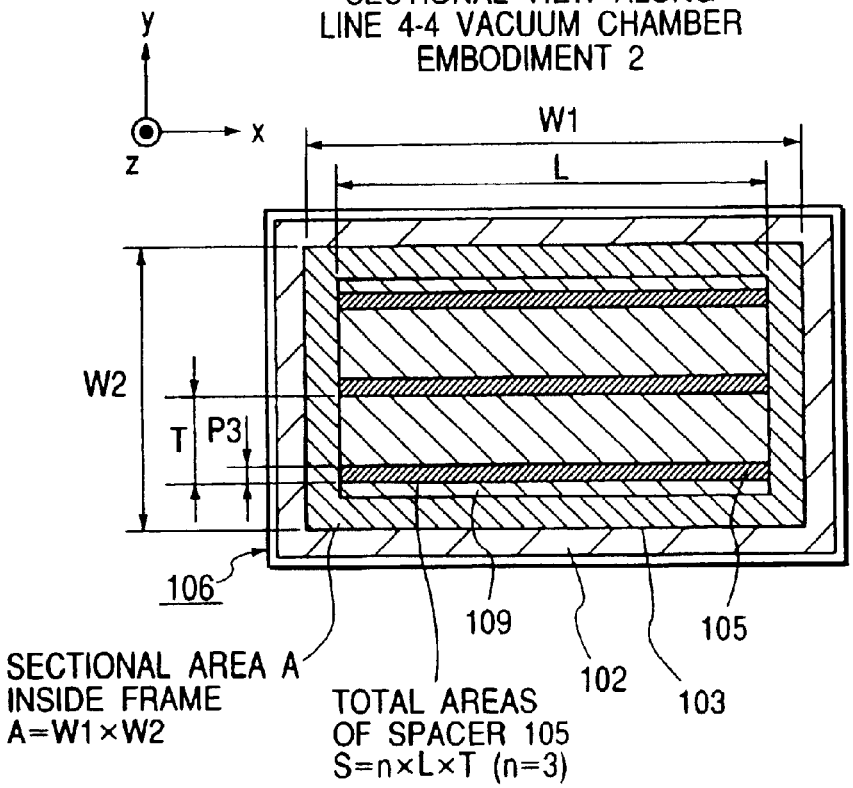
FIG. 6 is a schematic cross-sectional view showing an embodiment 2.

FIG. 6 is a cross-sectional view of a vacuum envelope employing elongated spacers, corresponding to a cross section 4—4 in FIG. 2. The elongated spacer means a spacer of which the representative length C of the cross section satisfies a relation $C \geqq H$, as exemplified by those shown in FIG. 7, wherein shown are plate-shaped spacers 105 (length L in the x-direction and length T in the y-direction), positioned at a pitch P3 in the y-direction of the vacuum envelope.

The present inventors have investigated the following configuration in order to realize a structure with limited deformation.

A first designing parameter in determining the shape and arrangement of the pillar-shaped or elongated spacers is to define the upper limit in the distortion (compression stress) of the spacer receiving the compressive force. As explained in the foregoing, the spacer supports the external force corresponding to the atmospheric pressure P (0.1 MPa), applied to the front substrate 101 and the rear substrate 102. The total load corresponding to the product ($P \times A$) of the atmospheric pressure P and the internal cross section A ($=W1 \times W2$) of the vacuum envelope. Such load is supported in dispersed manner by the plural spacers with a total cross section S, so that the average compression stress generated in the spacer is represented by $[P \times (A/S)]$. The total cross section S is represented by $S=n\pi \times R^2$ in case n cylindrical spacers of a radius R are employed as shown in FIG. 4, or $S=n \times T \times L$ in case n elongated spacers with a length L in the x-direction and a length T in the y-direction as shown in FIG. 6. The atmospheric pressure P does not significantly exceed 0.1 Mpa in the ordinary geographic or climatic conditions and can be safely regarded as constant at 0.1 Mpa. Also by defining the ratio S/A as the supporting efficiency $\eta$, the compression stress in the spacer is given by $P/\eta$, and it will be understood that the supporting efficiency $\eta$ is important in designing the spacer.

The present inventors have conducted a measurement and a simulation with the finite element method on the compression strength of the glass which is a principal material constituting the spacers and have obtained a conclusion that the average compression stress should desirably not exceed 555 MPa, corresponding to a supporting efficiency of 0.018% or higher. This is an important condition not dependent on the shape of the spacer, such as the pillar-shaped spacer or the elongated spacer.

On the other hand, the elongated spacer, having a larger cross section in comparison with the pillar-shaped spacer, can increase the pitch (P3) of the spacers. However, an increased pitch of the spacers may result in drawbacks such as the bending of the substrate and the tensile stress in a portion supported by the spacer. Therefore a second important condition is to suppress the tensile stress generated in the substrate.

Therefore, there were conducted measurement of the deformation of the vacuum envelope and simulation by the finite element method, for the front substrate 101 and the rear substrate 102 composed of soda lime glass plates (Young's modulus of 73 GPa and Poisson ratio of 0.23) with thicknesses T1, T2 within a range of 0.5 to 5 mm, and there was determined the condition for suppressing the tensile stress, generated in the substrate, to 8 MPa or lower that is sufficiently safe for the vacuum envelope. As a result, for constituting the preferred vacuum envelope, the pitch P3 of the plate-shaped spacers 105 shown in FIG. 6 should satisfy a condition $P3 \leqq 6.4$ mm for $T1=T2=0.5$ mm, or $P3 \leqq 64$ mm for $T1=T2=5$ mm. Also in consideration of the handling at manufacture or the control of vertical position, the length T in the y-direction is preferably 0.05 mm or larger, and, in order to suppress the influence on the pixels, the length T in the y-direction should preferably not exceed 0.5 mm. The aforementioned supporting efficiency $\eta$ is calculated to satisfy a relation $0.78\% \leqq \eta \leqq 7.8\%$ for $T1=T2=0.5$ mm, and a relation $0.078\% \leqq \eta \leqq 0.8\%$ for $T1=T2=5$ mm. By combining these results, the efficiency $\eta$ should satisfy a relation $0.078\% \leqq \eta \leqq 7.8\%$ and such condition is effective. There can also be conceived a configuration in which the plate-shaped spacers are partly omitted in the x-direction, but the required supporting efficiency is similar since the pitch P3 has to be reduced in such case.

In case support members are present between the image display area 107 and the frame member 103, namely in the image non-display area, the internal cross section of the vacuum envelope is given by the area connecting the inward points of such support members so as not to cross the image display area 107.

Then the vacuum envelope 106 is used for preparing the flat panel image display apparatus. The preparing process is the same as that disclosed in the aforementioned Japanese Patent Application Laid-Open No. 07-235255 and will be explained only briefly.

At first the rear substrate 102, bearing thereon the electron-emitting devices 109 etc., is set on a hot plate with the electron-emitting area 103 upwards, and frit glass is applied with a dispenser in positions where the spacers are to be provided. Then the spacers 104 are positioned on the frit glass by an exclusive jig, and heating is executed to adhere the spacers 104 to the rear substrate 102.

Then, on the rear substrate 102, there is set the frame 103 coated in advance with frit glass in the upper and lower parts in the z-direction, and the front substrate 101 bearing the phosphor 108 etc. is fixed thereon under such alignment that the phosphor 108 is opposed to the electron-emitting device 109. A hot plate is placed thereon and heating is executed to the adhesion temperature of the frit glass under a load. The components are thereafter cooled to obtain the hermetic vacuum envelope. Though not illustrated, an evacuation pipe is adhered to the rear substrate 102 or the front substrate 101. Then the interior is evacuated by an external vacuum pump and through the evacuation pipe to a vacuum level of about $10^{-6}$ Torr. Then the electron-emitting devices 109 are connected to an external driving board to execute an energization process, thereby providing such devices with the electron-emitting function. Then a driving voltage is applied to the electron-emitting device 109 to cause electron emission, and a high voltage of 3 to 15 kV is applied between the phosphor 108 and the electron-emitting device 109 to accelerate the electrons toward the phosphor 108 thereby causing light emission. The generated light is transmitted by the front substrate 101. When the front substrate 101 is observed from the exterior, an image of improved quality in comparison with the prior technology is displayed on the image display area 107. It is thus confirmed that the object of the present invention is attained.

The front substrate 101 and the rear substrate 102 are advantageously composed of iron-containing glass because of the low cost, but there may also be employed high-distortion point glass, alkali-free glass or pyrex glass.

The frame 103 is hermetically adhered to the first substrate 101 and the second substrate 102 by frit glass (not shown), but there may also be employed an inorganic or organic adhesive material. The frit glass is preferably composed of iron-containing glass because of the low cost, but there may also be employed high-distortion point glass, alkali-free glass or pyrex glass. It may also be composed of ceramics, a metal alloy such as alloy 426, or frit glass only. Also the frame member 103 may be integral with and continuous for example to the first substrate 101.

The pillar-shaped spacer in the foregoing embodiment has been composed of a cylindrical spacer, but there may also be employed a pillar-shaped spacer with an oval cross section, a rectangular cross section or a polygonal cross section.

Also the elongated spacer in the foregoing embodiment has been composed of a plate-shaped spacer, but there may also be employed a spacer with a polygonal cross section.

Also the pillar-shaped or elongated spacer may have a cross section varying along the direction perpendicular to the cross section shown in FIG. 4 along line 4—4 in FIG. 2, and may be so formed as to be constricted or expanded in the center. In the present invention, the cross section 4—4 is so selected that the cross section of the spacer becomes smallest.

Also in the foregoing embodiments, the cylindrical spacers 104 or the plate-shaped spacers 105 of a same size are arranged with a constant pitch P1, P2 or P3, but the present invention is not limited to such configuration and the spacers of different sizes or shapes may be arranged in an uneven manner as long as the height H of such spacers is constant.

For example it is possible to mix the pillar-shaped spacers of polygonal cross section and the cylindrical spacers and to arrange such spacers with a regular pitch, or to arrange the pillar-shaped spacers and the plate-shaped spacers in an uneven manner so as not to disturb the image, or to arrange the elongated spacers of two different sizes in uniform manner. However, in order to support the load applied to the substrates, all the spacers have to have a constant height H.

Also in the foregoing, the electron-emitting device has been explained by the surface conduction electron-emitting device, but the present invention is not limited to such configuration and there may be adopted another cold cathode electron-emitting device such as a field emission type.

EXAMPLE 1

FIGS. 1 to 5 illustrate an example of the vacuum envelope of the present invention, wherein FIG. 1 is a schematic view of the vacuum envelope for use in a flat panel display; FIG. 2 is a cross sectional view along a line 2—2 in FIG. 1; FIG. 3 is a cross-sectional view along a line 3—3 in FIG. 1; FIG. 4 is a cross-sectional view along a line 4—4 in FIG. 2; and FIG. 5 is a perspective view of a spacer.

Referring to these drawings, there are shown a front substrate 101 (thickness T1=2.8 mm); a rear substrate 102 (thickness T2=2.8 mm) provided in a position opposed to the front substrate 101; and a frame member 103 positioned between the two substrates and hermetically adhered thereto, wherein the distance D between the two substrates is 2 mm. The internal dimensions of the frame member 103 have a length W1 of 112 mm in the x-direction and W2 of 52 mm in the y-direction. The frame 103, the front substrate 101 and the rear substrate 102 are hermetically adhered with frit glass (not shown). Cylindrical spacers 105 (radius R=0.1 mm, height H=2 mm) having a circular cross section are provided between the two substrates and positioned on square grid points of a pitch P1=P2=12 mm, and are provided in 50 units.

The front substrate 101, the rear substrate 102, the frame member 103 and the cylindrical spacers 105 are composed of iron-containing glass. A vacuum envelope 106 is constituted by these components.

The rear substrate 102 is provided thereon with surface conduction electron-emitting devices 109 for electron emission, and the front substrate 101 is provided thereon with a phosphor 108 for emitting light by irradiation with the electrons thereby displaying an image. An image display area 107 (120×67 mm) displays an image by the light emission of the phosphor 108.

Referring to FIG. 4, the internal area A of the frame 103 in the cross section 4—4 is equal to W1×W2 and is therefore 5824 $mm^2$. The total cross section S, being the sum of cross section of 50 spacers 104, is given by $S=50\times n\times R^2=1.57$ $mm^2$, so that the supporting efficiency n is given by S/A which is equal to 0.027%. This corresponds to the configuration of the desirable vacuum envelope.

In the following there will be explained the flat panel image display apparatus employing the vacuum envelope 106.

At first the rear substrate 102, bearing thereon the electron-emitting devices 109 etc., is set on a hot plate with the electron-emitting area 103 upwards, and frit glass is applied with a dispenser in positions where the cylindrical spacers 104 are to be provided. Then the cylindrical spacers 104 are positioned on the frit glass by an exclusive jig, and heating is executed to adhere the spacers 104 to the rear substrate 102.

Then, on the rear substrate 102, there is set the frame 103 coated in advance with frit glass in the upper and lower parts in the z-direction, and the front substrate 101 bearing the phosphor 108 etc. is fixed thereon under such alignment that the phosphor 108 is opposed to the electron-emitting device 109. A hot plate is placed thereon and heating is executed to the adhesion temperature of the frit glass under a load. The components are thereafter cooled to obtain the hermetic vacuum envelope. Though not illustrated, an evacuation pipe is adhered to the rear substrate 102 or the front substrate 101. Then the interior is evacuated by an external vacuum pump and through the evacuation pipe to a vacuum level of about $10^{-6}$ Torr. Then the electron-emitting devices 109 are connected to an external driving board to execute an energization process, thereby providing such devices with the electron-emitting function. Then a driving voltage is applied to the electron-emitting device 109 to cause electron emission, and a high voltage of 3 to 15 kV is applied between the phosphor 108 and the electron-emitting device 109 to accelerate the electrons toward the phosphor 108 thereby causing light emission. The generated light is transmitted by the front substrate 101. When the front substrate 101 is observed from the exterior, an image of improved quality in comparison with the prior technology is displayed on the image display area 107. It is thus confirmed that the object of the present invention is attained.

EXAMPLE 2

Figure 7:
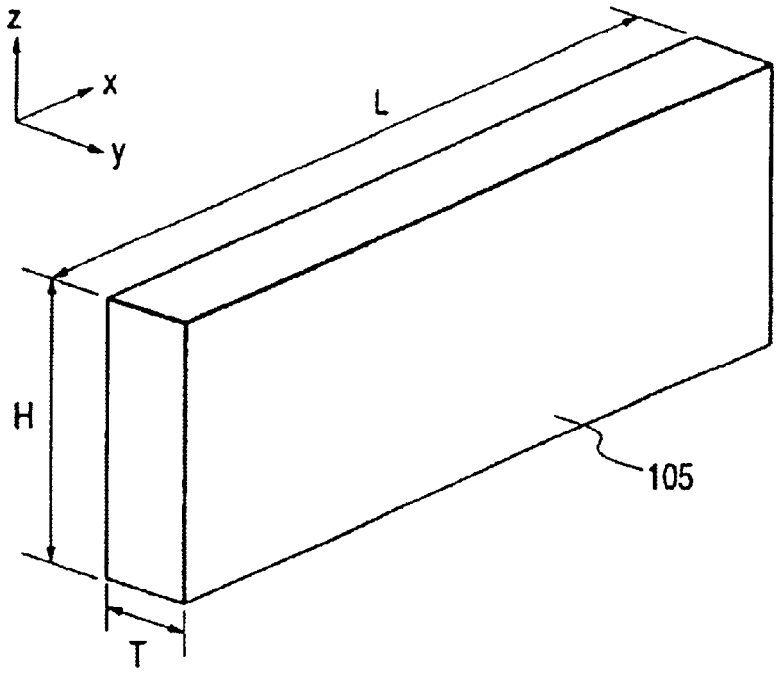
FIG. 7 is a perspective view showing the embodiment 2.
Figure 8:
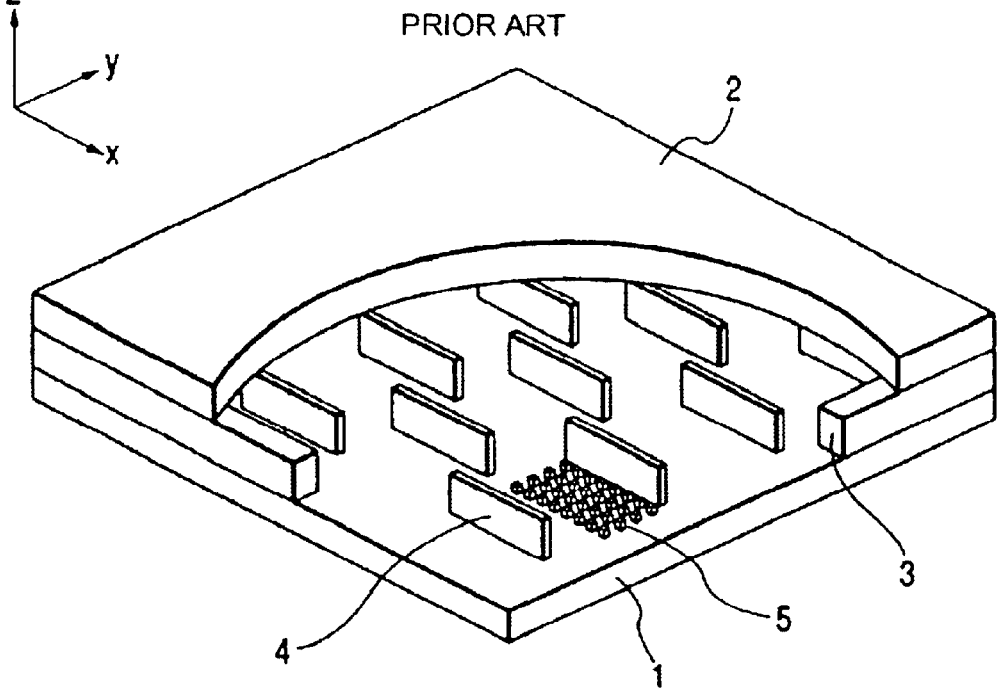
FIG. 8 PRIOR ART
FIG. 8 is a view showing a conventional configuration.

FIGS. 6 and 7 illustrate another embodiment of the vacuum envelope of the present invention, wherein FIG. 6 is a cross-sectional view of the vacuum envelope for use in a flat panel display, corresponding to FIG. 4 in the example 1, and FIG. 7 is a perspective view of a spacer.

Referring to these drawings, there are shown a front substrate 101 (thickness T1=2.8 mm); a rear substrate 102 (thickness T2=2.8 mm) provided in a position opposed to the front substrate 101 and separated from the front substrate 101 by a substrate interval D=2 mm; and a frame member 103 positioned between the two substrates and hermetically adhered thereto. The internal dimensions of the frame member 103 have a length W1 of 112 mm in the x-direction and W2 of 52 mm in the y-direction. The frame 103, the front substrate 101 and the rear substrate 102 are hermetically adhered with frit glass (not shown). Plate-shaped spacers 105 (length L of 108 mm in the x-direction and T of 0.2 mm in the y-direction with a height H=2 mm) which are elongated spacers are provided between the two substrates in three units in uniform manner with a pitch P3 of 20 mm in the y-direction. A vacuum envelope 106 is constituted by these components, and the front substrate 101, the rear substrate 102, the frame member 103 and the plate-shaped spacers 105 are composed of high-distortion point glass.

The rear substrate 102 is provided thereon with surface conduction electron-emitting devices 109 for electron emission, and the front substrate 101 is provided thereon with a phosphor 108 for emitting light by irradiation with the electrons thereby displaying an image. An image display area 107 (120×67 mm) displays an image by the light emission of the phosphor 108.

Referring to FIG. 6, the internal area A of the frame 103 in the cross section 4—4 is equal to W1×W2 and is therefore 5824 $mm^2$. The total cross section S, being the sum of cross section of three plate-shaped spacers 105, is given by $S=n\times T\times L=64.8\ mm^2$.

The supporting efficiency η is therefore 1.1%, providing a vacuum envelope of desirable configuration.

The vacuum envelope 106 is used for preparing a flat panel image display apparatus.

At first the rear substrate 102, bearing thereon the electron-emitting devices 109 etc., is set on a hot plate with the electron-emitting area 103 upwards, and frit glass is applied with a dispenser in positions where the elongated spacers 105 are to be provided. Then the elongated spacers 105 are positioned on the frit glass by an exclusive jig, and heating is executed to adhere the spacers 105 to the rear substrate 102.

Then, on the rear substrate 102, there is set the frame 103 coated in advance with frit glass in the upper and lower parts in the z-direction, and the front substrate 101 bearing the phosphor 108 etc. is fixed thereon under such alignment that the phosphor 108 is opposed to the electron-emitting device 109. A hot plate is placed thereon and heating is executed to the adhesion temperature of the frit glass under a load. The components are thereafter cooled to obtain the hermetic vacuum envelope. Though not illustrated, an evacuation pipe is adhered to the rear substrate 102 or the front substrate 101. Then the interior is evacuated by an external vacuum pump and through the evacuation pipe to a vacuum level of about $10^{-6}$ Torr. Then the electron-emitting devices 109 are connected to an external driving board to execute an energization process, thereby providing such devices with the electron-emitting function. Then a driving voltage is applied to the electron-emitting device 109 to cause electron emission, and a high voltage of 3 to 15 kV is applied between the phosphor 108 and the electron-emitting device 109 to accelerate the electrons toward the phosphor 108 thereby causing light emission. The generated light is transmitted by the front substrate 101. When the front substrate 101 is observed from the exterior, an image of improved quality in comparison with the prior technology is displayed on the image display area 107. It is thus confirmed that the object of the present invention is attained.

As explained in the foregoing, the present invention provides a vacuum envelope having a supporting structure for the atmospheric pressure based on desirable spacers, thereby allowing to produce a flat panel image display apparatus of improved image quality with such vacuum envelope.

What is claimed is:

1. A method of producing a vacuum envelope comprising the steps of:

preparing a first substrate having a thickness $T_1$;

bonding a plurality of spacers to the first substrate;

arranging a second substrate, having a thickness $T_2$, to be disposed in opposition to the first substrate and sandwiching therebetween the spacers; and forming the vacuum envelope between the first and second substrates under a load, wherein a ratio η defined by S/A, in which A is an internal cross-sectional area of the vacuum envelope in a cross-section parallel to a plane of the first substrate opposed to the second substrate, or a plane of the second substrate opposed to the first substrate, and S is the total cross-sectional area of the plurality of spacers on such cross-section, satisfies a relation $0.78\% \leqq \eta \leqq 7.8\%$, with $T_1$ and $T_2$ in a range 0.5–5 mm, and said step of forming the vacuum envelope is conducted with exerting a load to hold the first and second substrates together.

2. A method according to claim 1, wherein said step of forming the vacuum envelope is conducted with exerting the load to hold the first and second substrate together with a hot plate.

* * * * *

UNITED STATES PATENT AND TRADEMARK OFFICE

CERTIFICATE OF CORRECTION

PATENT NO. : 6,929,524 B2
DATED : August 16, 2005
INVENTOR(S) : Tomokazu Ando

It is certified that error appears in the above-identified patent and that said Letters Patent is hereby corrected as shown below:

Column 3,
Line 64, "corresponding" should read -- corresponds --.

Column 4,
Line 30, "measurement" should read -- measurements --.

Column 6,
Line 52, "section" should read -- sections --.

Column 7,
Line 62, "section" should read -- sections --.

Signed and Sealed this

Thirteenth Day of June, 2006

JON W. DUDAS
*Director of the United States Patent and Trademark Office*